US007125139B2

(12) United States Patent
Kumthampinij et al.

(10) Patent No.: US 7,125,139 B2
(45) Date of Patent: Oct. 24, 2006

(54) FLASHLIGHT

(75) Inventors: Yos Kumthampinij, Jersey City, NJ (US); Kenneth Zorovich, Hoboken, NJ (US)

(73) Assignee: Princeton Tectonics, Inc., Bordentown, NJ (US)

( * ) Notice: Subject to any disclaimer, the term of this patent is extended or adjusted under 35 U.S.C. 154(b) by 35 days.

(21) Appl. No.: 11/066,076

(22) Filed: Feb. 25, 2005

(65) Prior Publication Data

US 2006/0193127 A1 Aug. 31, 2006

(51) Int. Cl.
*F21L 4/00* (2006.01)

(52) U.S. Cl. ..... 362/200; 362/800; 362/103; 362/108

(58) Field of Classification Search ..... 362/200, 362/800, 199, 103, 105, 108, 208, 804
See application file for complete search history.

(56) References Cited

U.S. PATENT DOCUMENTS 4,916,596 A * 4/1990 Sharrah et al. ..... 362/190
5,720,543 A * 2/1998 Sheps ..... 362/196

* cited by examiner

*Primary Examiner*—Sharon Payne
(74) *Attorney, Agent, or Firm*—Howson & Howson

(57) ABSTRACT

In auxiliary headlamp, for attachment to the headstrap of a personal headlamp, a lamp body is removably attachable to a strap bracket having a strap-receiving slot through which a headstrap can extend. When the lamp body is attached to the strap bracket, the lamp body is rotatable about an axis of rotation which extends in perpendicular relationship to the portion of the headstrap held in the slot, and the lamp is arranged to project a beam of light in substantially perpendicular relationship to the axis of rotation of about which the lamp body is rotatable.

14 Claims, 6 Drawing Sheets

FLASHLIGHT

FIELD OF THE INVENTION

This invention relates generally to flashlights, such as flashlights adapted to be worn on the heads of individuals as personal headlamps. Such headlamps are worn to provide illumination in a wide variety of applications, including camping, hiking, cave exploration, diving, and the like. The invention relates more particularly to a device adapted for use as an auxiliary flashlight, which may be attached to the headstrap of a primary personal headlamp, or to another strap, such as a belt, the strap of a backpack, or the like.

BACKGROUND OF THE INVENTION

Typical personal headlamps are shown in U.S. Design patents D405202 dated Feb. 2, 1999, and D470615, dated Feb. 18, 2003. In most cases, the headlamp is supported on the wearer's head by a headstrap, in the form of a band of flexible material, usually a stretchable fabric, adapted to fit about an individual's head so that the headlamp is supported on the forehead. The headstrap extends through slots in a bracket attached to an assembly comprising one or more incandescent bulbs or light-emitting diodes, a reflector, a switch, and associated electrical wiring or control circuitry. The assembly may include a power source compartment for containing one or more electrochemical cells ("batteries"). However, in the case of higher power headlamps, the power source compartment is often a separate unit at a location remote from the light-emitting device or devices.

One of the problems encountered by users of personal headlamps is that drainage of the power source can result in inopportune loss of illumination. Moreover, it is usually difficult to replace the batteries, especially in the dark, and when the power source compartment is closed by screw fasteners or the like, so that a tool is required to open it. Failure of the headlamp can also occur due to filament burn-out in the case of an incandescent bulb, and for various other reasons such as mechanical failure of a switch, or corrosion due to moisture. There is a need, therefore, for a suitable auxiliary illumination device to serve as a back-up source of illumination in the event of failure of the primary headlamp.

Carrying a second headlamp or flashlight as a spare is generally not a practical solution, especially in hiking and other activities where pack weight minimization is important. Moreover, providing two headlamps on a single headstrap is unwieldy, and requires the user to carry significant additional weight.

BRIEF SUMMARY OF THE INVENTION

Objects of this invention, therefore, are to provide an auxiliary device that can be used as a back-up source of illumination in the event of failure of a primary headlamp or other portable source of illumination, to provide for quick and convenient operation of the auxiliary device in the event of an emergency, and to minimize the added weight that the user must carry. It is also an object of the invention to provide an auxiliary illumination device the aim of which can be adjusted easily, and to provide an illumination device that can be quickly and easily detached from a strap, such as the headband of a personal headlamp, so that it can be used as a hand-held flashlight, but which is normally held securely in place on the strap.

In accordance with the invention, a flashlight for attachment to a strap, comprises a lamp body, and a strap bracket having a strap-receiving slot through which a strap can extend with a portion of the strap held in the slot. The lamp body is removably attachable to the strap bracket, and, when the portion of the strap is held in the strap-receiving slot, and the lamp body is attached to the strap bracket, the lamp body is rotatable about an axis of rotation which extends in perpendicular relationship to the portion of the strap held in the slot, and the lamp is arranged to project a beam of light in substantially perpendicular relationship to the axis about which the lamp body is rotatable.

In the preferred embodiment, the lamp body has inner and outer walls facing in opposite directions, and the light source is mounted on the lamp body and arranged to project light in a direction transverse to the directions in which the inner and outer walls face. At least two retaining projections are fixed to the inner wall of the lamp body. Each retaining projection is spaced radially from a common axis extending along said opposite directions. Each projection has a leg extending in the direction in which the inner wall faces, and a foot spaced from the inner wall and extending from the leg radially with respect to the common axis. The strap bracket a slotted face having, for each retaining projection, a corresponding arcuate slot centered on the common axis. The leg of each of the retaining projections extends through a corresponding arcuate slot and is slidable therein as said lamp body is rotated about the common axis. Each slot has an undercut cross-section accommodating the radially extending foot of its corresponding retaining projection, and each arcuate slot is sufficiently narrow to prevent the foot of its corresponding retaining projection from passing outwardly therethrough. The slots have open ends positioned so that the legs of the retaining projections can pass therethrough substantially simultaneously for detachment of the lamp body from the strap bracket.

Preferably, cooperating detent elements are provided on the lamp body and the strap bracket. These cooperating elements are engageable in each of a plurality of rotational positions of the lamp body about the common axis, for retaining the lamp body in any selected one of the plurality of rotational positions. The detent elements on the lamp body and the strap bracket are preferably resiliently engageable, so that the retention of the lamp body in each of the rotational positions can be overcome by manual application of a predetermined twisting force to the lamp body.

The strap-receiving slot preferably has parallel upper and lower boundaries for engagement with the opposite edges of a strap extending through it, and the light source is adapted to project a beam of light in a pattern substantially symmetrical about a central axis transverse to the directions in which the inner and outer walls of the lamp body face. The retaining projections are positioned so that they are adjacent the openings of their corresponding arcuate slots, but outside the slots, for attachment and detachment of the lamp body to and from the strap bracket, when the lamp body is tilted so that the central axis of the beam of light projected by the light source is tilted relative to the parallel upper and lower boundaries of the strap-receiving slot.

Preferably, the arcuate slots extend about the common axis through ranges such that, by rotation of the lamp body about the common axis, the central axis of the beam of light can be aimed both above and below a direction parallel to the parallel upper and lower boundaries of the strap-receiving slot.

The outer wall of the lamp body is preferably constituted in part by a manually actuable operating button for switching electrical power to the light source, and an electrical power source is preferably located within the lamp body.

In a preferred embodiment, the flashlight is used as an auxiliary headlamp, for attachment to the headstrap of a personal headlamp.

Other objects, details and advantages of the invention will be apparent from the following detailed description when read in conjunction with the drawings.

DETAILED DESCRIPTION OF THE PREFERRED EMBODIMENT

Figure 1:
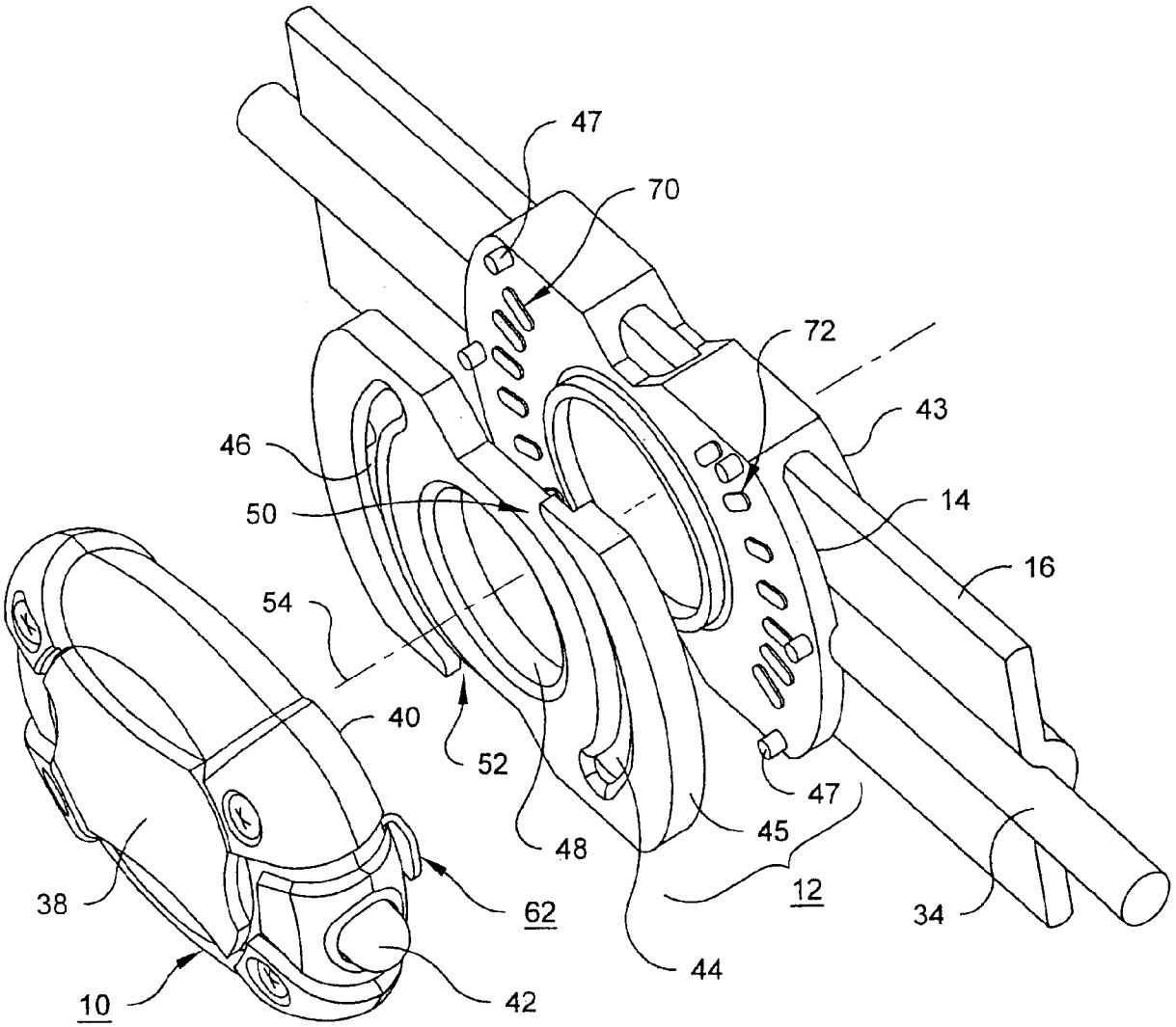
FIG. 1 is an exploded perspective view of an auxiliary headlamp in accordance with the invention, the headlamp comprising, as its principal components, a lamp body, and a strap bracket.
Figure 6:
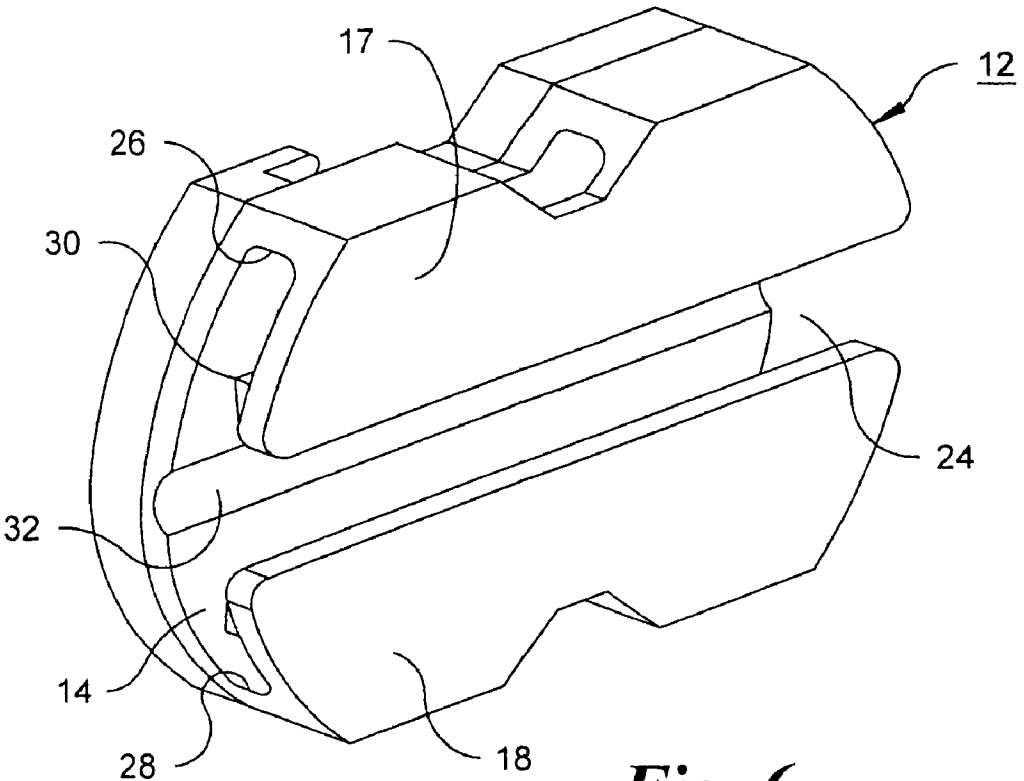
FIG. 6 is a perspective view showing the rear side of the strap bracket.

As shown in FIG. 1, the auxiliary headlamp of the invention comprises a lamp body 10 arranged for detachable connection to a strap bracket 12, which has a slot 14 through which a flexible headstrap 16 extends. As shown in FIG. 6, the slot 14 is preferably formed by upper and lower hook-shaped elements 17 and 18. The upper and lower hook-shaped elements are separate from each other so that an opening 24 is provided allowing a flexible headstrap to be pushed into the slot though the opening. Consequently the bracket can be attached to the headstrap without the need for threading an end of the strap longitudinally through slot 14.

The upper and lower boundaries 26 and 28 of the slot 14 should be parallel to each other, and spaced from each other by a distance approximately equal to the width of the strap, so that the bracket will not tilt on the strap. Barbs, e.g., barb 30, may be formed on the tips of the hook-shaped elements to ensure secure attachment of the bracket 12 to the strap. A semicylindrical groove 32 is preferably formed in a wall of the strap bracket to receive a cable 34 (FIG. 1), which may be used when the main headlamp and its power supply are separate from each other.

Figure 2:
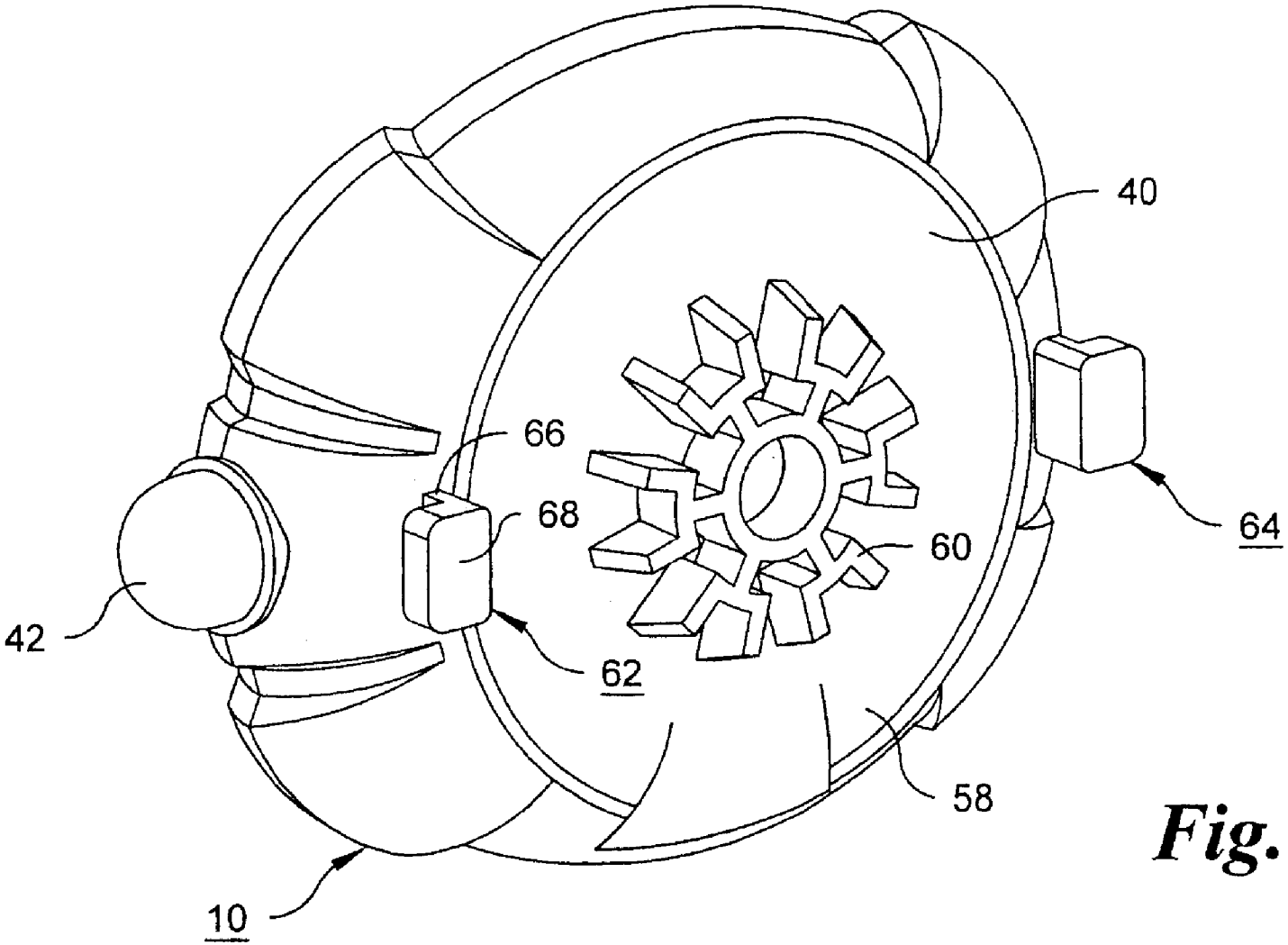
FIG. 2 is a perspective view of the rear of the lamp body.

As shown in FIG. 1, the lamp body 10 has a front wall, constituted in part by a manually operable push-button 38, and rear wall 40. The front and rear walls face in opposite directions. A light source 42, preferably a light-emitting diode (LED) also shown in FIG. 2, is mounted at an edge of the lamp body, and, when activated, projects a light beam which is preferably symmetrical about a central beam axis extending transverse to the directions in which the front and rear walls face. A switch (not shown) behind push-button 38 is preferably of a well-known type which performs a different function for each of several successive depressions. In its simplest form, on successive depressions of the push-button, the switch opens and closes an electrical connection between the light source and a power source such as an electrochemical "coin" cell (not shown) inside the lamp body 10. Optionally, the function of the switch may be more complex. For example, successive depressions of the push button may provide several levels of brightness in the light emitted by the light source 42. The switch may also provide for one or more flashing modes, if desired. Especially in the case of multiple brightness levels and flashing, the switch may include electronic control circuitry. Reference may be made to U.S. Pat. No. 6,249,089, which is incorporated by reference, for details of typical control circuitry.

Figure 7:
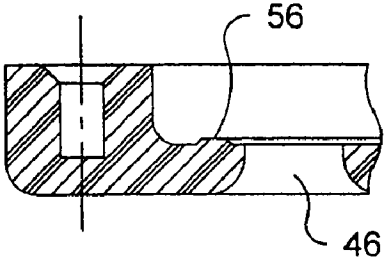
FIG. 7 is a cross-sectional view of one of the arcuate slots of the lamp bracket, taken on section plane 7—7 in FIG. 3.

As shown in FIG. 1, the strap bracket 12 is composed of two principal parts, a strap-receiving body 43, and a slotted plate 45. These two parts are preferably fixed to each other permanently by cooperation of projections 47 formed on body 43, and projection-receiving holes (not shown) formed on the plate 45. Two arcuate slots, 44 and 46, are formed in the plate 45, on opposite sides of a central opening 48. These slots have open ends 50 and 52, respectively. The slots are centered on a common axis 54 extending through the center of opening 48, and are preferably, but not necessarily, equidistant from the common axis. Each slot preferably subtends an angle of approximately 90 degrees about axis 54. As shown in FIG. 7, the slots have an undercut cross-section providing an inside retaining surface, slot 46 having a retaining surface 56. Although the slots 44 and 46 are configured so that their open ends face open space, as an alternative, the plate 45 can be formed so that the slots are connected to, and continuous with, openings formed in the plate, the openings being wider than the slots.

As shown in FIG. 2, the rear wall 40 of the lamp body 10 has a centrally located, removable, power source cover 58 having a projection 60, preferably in the form of a symmetrical pattern of ridges, outer tips of which are located on a circle having a diameter corresponding to the diameter of opening 48 (FIG. 1) in the strap bracket. The rear wall 40 is also provided, on diametrically opposite sides of the power source cover, with L-shaped projections 62 and 64, each comprising a leg extending in the direction in which wall 40 faces, and a foot spaced from wall 40 and extending from the leg radially with respect to the center of the power supply cover. Thus, projection 62 comprises a leg 66 and a foot 68. Projection 64 has a similar configuration. In the embodiment shown, the feet of the projections extend radially outward. However, as an alternative, they can extend radially inward. The shapes and directions of the legs and feet of the projections can depart to some degree from the specific shapes and directions depicted and described, so long as the projections are capable of cooperation with the arcuate slots in the strap bracket. In either case, the projections are preferably aligned with each other along a line parallel to the light beam axis, that is the axis about which the beam emitted by the light source 42 (if turned on) would be substantially symmetrical.

The projections 62 and 64 are positioned relative to each other, and to the open ends of slots 44 and 46, so that, when projection 60 enters hole 48, the projections can move, in the direction of axis 54, to positions such that, upon rotation of the lamp body, their legs can enter the slots.

Figure 3:
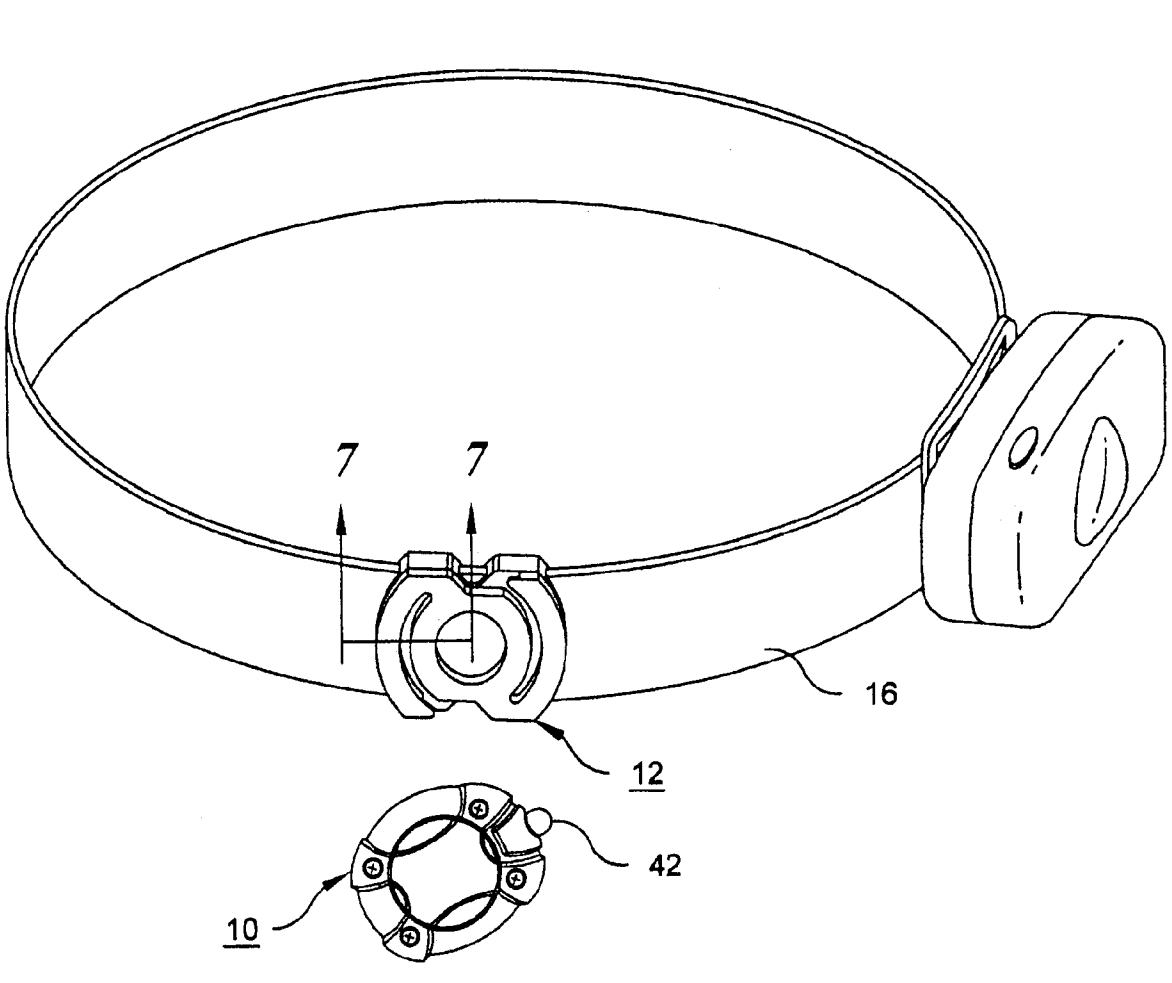
FIG. 3 is an exploded perspective view illustrating the strap bracket on the head strap of a main headlamp, and the lamp body of the auxiliary headlamp separated from the strap bracket.

As shown in FIG. 3, the lamp body, about to be connected to bracket 12 on headstrap 16, is tilted upward, that is, so that the central axis of the light beam that would be emitted by light source 42, if turned on, would be directed upward at an angle of approximately 45 degrees relative to the direction of the upper and lower boundaries of the strap-receiving slot of the bracket. In this position, the projections 62 and 64

Figure 4:
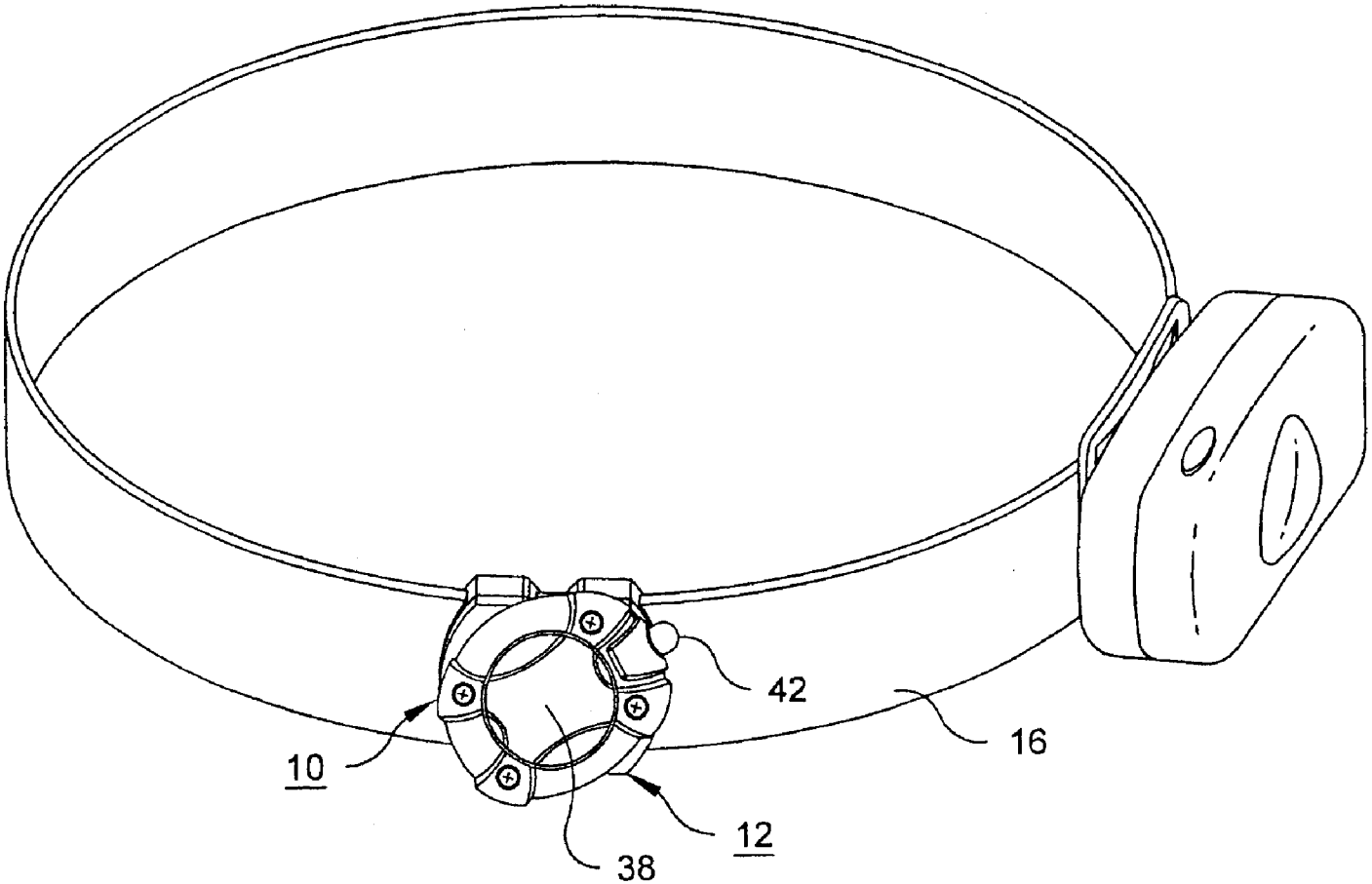
FIG. 4 is a perspective view illustrating the auxiliary headlamp on the head strap of a main headlamp, the lamp body being tilted upward.
Figure 5:
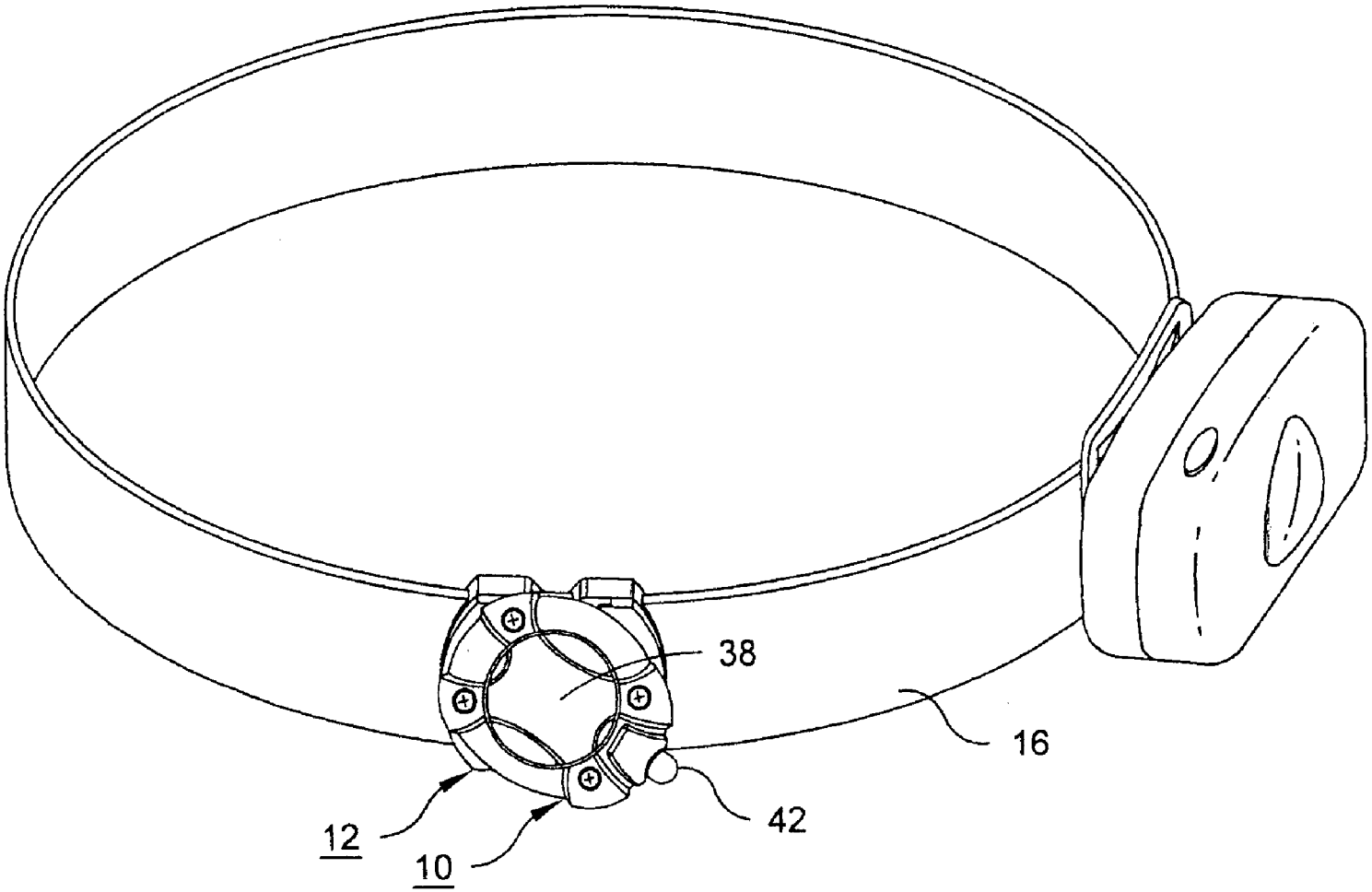
FIG. 5 is a perspective view illustrating the auxiliary headlamp on the head strap of a main headlamp, the lamp body being tilted downward.

(FIG. 2 can enter the openings at the ends of the arcuate slots of the strap bracket, and the lamp body can be connected to the strap bracket as shown in FIG. 4 in an upwardly tilted position. The lamp body can then be tilted through a range of approximately 90 degrees, through a central position in which it can project a beam of light forward in a direction parallel to the upper and lower boundaries of the strap-receiving slot, to a position, as shown in FIG. 5, where it can project a beam of light downward at an angle approximately 45 degrees.

The feet of the projections 62 and 64 are cooperatively engageable with detents formed as protuberances on the front face of strap-receiving body 43, as shown in FIG. 1. The detents are in two series, 70 and 72, each series being generally arcuate in shape. The detents cooperate with the feet 62 and 64 on the lamp body to hold the lamp body in selected angular positions, both above and below a direction defined by the upper and lower boundaries 26 and 28 (FIG. 6) of the strap slot. Because the detents and the feet are resilient, the retention by the detents can be overcome by manual application of a predetermined twisting force to the lamp body.

As will be apparent from the above description and the drawings, the strap bracket of the auxiliary flashlight can be secured to a headstrap of a headlamp, or to any similar strap, and the lamp body can be secured to the strap bracket by positioning its projections 62 and 64 so that the legs are located adjacent the open ends of slots 44 and 46, respectively, and then rotating the lamp body so that the legs of the projections enter the slots and the feet of the projections are situated within the recessed area behind the slotted plate 45. Lamp body can be held at any one of several selected positions by the cooperation of the feet of projections 62 and 64 with the detents in detent series 72 and 70.

The lamp body can be readily attached to, and detached from, the strap and operated either while attached to the strap, or while separated from the strap. While attached to the strap, the auxiliary lamp can be adjusted to, and held in, any of several positions, in order to direct the light emitted by light source 42 either horizontally, or at any of several discrete angles above and below horizontal.

Various modifications in addition to those specifically mentioned above can be made to the auxiliary flashlight in accordance with the invention. For example, lamp body can be formed in any of a variety of shapes; the feet need not be aligned with the light source; and the strap bracket can be constructed without opening 24 (FIG. 6). The detent structure can take various other forms. For example, plural projections can be provided on the lamp body, for cooperation with one or more projections formed on the strap bracket. Still other modifications may be made to the invention described above without departing from the scope of the invention as defined in the following claims.

The invention claimed is:

1. A flashlight for attachment to a strap, the flashlight comprising:

a lamp body;

a strap bracket having a strap-receiving slot through which a strap can extend with a portion of said strap being held in said slot;

said lamp body being removably attachable to said strap bracket, and, when said portion of the strap is held in said slot, and said lamp body is attached to said strap bracket, the lamp body being rotatable about an axis of rotation which extends in perpendicular relationship to said portion of the strap held in said slot, and the lamp being arranged to project a beam of light in substantially perpendicular relationship to said axis of rotation.

2. A flashlight for attachment to a strap, the flashlight comprising:

a lamp body having inner and outer walls facing in opposite directions, a light source mounted on said lamp body and arranged to project light in a direction transverse to the directions in which said inner and outer walls face; and at least two retaining projections fixed to said inner wall of the lamp body, each retaining projection being spaced radially from a common axis extending along said opposite directions, and having a leg extending in the direction in which said inner wall faces, and a foot spaced from said inner wall and extending from the leg radially with respect to said common axis;

a strap bracket having a strap-receiving slot through which a strap can extend, and a slotted face having, for each said retaining projection, a corresponding arcuate slot centered on said common axis, the leg of each of said retaining projections extending through the corresponding arcuate slot and being slidable therein as said lamp body is rotated about said common axis, each said slot having an undercut cross-section accommodating the radially extending foot of its corresponding retaining projection, and each arcuate slot being sufficiently narrow to prevent the foot of its corresponding retaining projection from passing outwardly therethrough, but having an open end, the open ends of said slots being positioned so that the legs of the retaining projections can pass therethrough substantially simultaneously for detachment of the lamp body from said strap bracket.

3. A flashlight according to claim 2, including cooperating detent elements on said lamp body and said strap bracket, said cooperating elements being engageable with each other in each of a plurality of rotational positions of said lamp body about said common axis, for retaining said lamp body in any selected one of said plurality of rotational positions.

4. A flashlight according to claim 3, in which said detent elements on the lamp body and said strap bracket are resiliently engageable, whereby the retention of said lamp body in each of said rotational positions can be overcome by manual application of a predetermined twisting force about said common axis to said lamp body.

5. A flashlight according to claim 2, in which:

said strap-receiving slot has parallel upper and lower boundaries for engagement with the opposite edges of a strap extending through said strap-receiving slot;

said light source is adapted to project a beam of light in a pattern substantially symmetrical about a central axis transverse to the directions in which said inner and outer walls of the lamp body face; and said retaining projections are positioned to be adjacent the openings of their corresponding arcuate slots, but outside said slots, for attachment and detachment of the lamp body to and from said strap bracket, when the lamp body is tilted so that said central axis of the beam of light projected by the light source is tilted relative to said parallel upper and lower boundaries of the strap-receiving slot.

6. A flashlight according to claim 2, in which said strap-receiving slot has parallel upper and lower boundaries for engagement with the opposite edges of a strap extending through said strap-receiving slot, said light source is adapted to project a beam of light in a pattern substantially symmetrical about a central axis transverse to the directions in which said inner and outer walls of the lamp body face, and in which said arcuate slots extend about said common axis through ranges such that, by rotation of the lamp body about said common axis, the central axis of said beam of light can be aimed both above and below a direction parallel to said parallel upper and lower boundaries of the strap-receiving slot.

7. A flashlight according to claim 3, in which said strap-receiving slot has parallel upper and lower boundaries for engagement with the opposite edges of a strap extending through said strap-receiving slot, said light source is adapted to project a beam of light in a pattern substantially symmetrical about a central axis transverse to the directions in which said inner and outer walls of the lamp body face, and in which said arcuate slots extend about said common axis through ranges such that, by rotation of the lamp body about said common axis, the central axis of said beam of light can be aimed both above and below a direction parallel to said parallel upper and lower boundaries of the strap-receiving slot.

8. A flashlight according to claim 4, in which said strap-receiving slot has parallel upper and lower boundaries for engagement with the opposite edges of a strap extending through said strap-receiving slot, said light source is adapted to project a beam of light in a pattern substantially symmetrical about a central axis transverse to the directions in which said inner and outer walls of the lamp body face, and in which said arcuate slots extend about said common axis through ranges such that, by rotation of the lamp body about said common axis, the central axis of said beam of light can be aimed both above and below a direction parallel to said parallel upper and lower boundaries of the strap-receiving slot.

9. A flashlight according to claim 5, in which said arcuate slots extend about said common axis through ranges such that, by rotation of the lamp body about said common axis, the central axis of said beam of light can be aimed both above and below a direction parallel said parallel upper and lower boundaries of the strap-receiving slot.

10. A flashlight according to claim 5, in which, in each said arcuate slot, the opening thereof is positioned at an end of the slot at a location such that, for removal from said strap bracket, the lamp must be rotated about said common axis to a position in which the legs of the projections on said lamp body move out of the arcuate slots through the openings thereof, and in which said arcuate slots extend about said common axis through ranges such that, by rotation of the lamp body about said common axis, the central axis of said beam of light can be aimed both above and below a direction parallel said parallel upper and lower boundaries of the strap-receiving slot.

11. A flashlight according to claim 2, in which said outer wall of the lamp body is constituted in part by a manually actuable operating button for switching electrical power to said light source.

12. A flashlight according to claim 2, including an electrical power source located within said lamp body.

13. A flashlight according to claim 2, including an electrical power source located within said lamp body, and in which said outer wall of the lamp body is constituted in part by a manually actuable operating button for switching electrical power to said light source.

14. An auxiliary headlamp, for attachment to the headstrap of a personal headlamp, comprising:

a lamp body;

a strap bracket having a strap-receiving slot through which a headstrap can extend with a portion of said headstrap being held in said slot;

said lamp body being removably attachable to said strap bracket, and, when said portion of the headstrap is held in said slot, and said lamp body is attached to said strap bracket, the lamp body being rotatable about an axis of rotation which extends in perpendicular relationship to said portion of the headstrap held in said slot, and the lamp being arranged to project a beam of light in substantially perpendicular relationship to said axis of rotation.

* * * * *